US009103289B2

(12) United States Patent
Gwosdz et al.

(10) Patent No.: US 9,103,289 B2
(45) Date of Patent: Aug. 11, 2015

(54) METHOD FOR CONTROLLING THE LIMITING OF THE ROTATIONAL SPEED OF A COMBUSTION ENGINE

(75) Inventors: Fabian Gwosdz, Schorndorf (DE); Claus Naegele, Stuttgart (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 668 days.

(21) Appl. No.: 13/362,128

(22) Filed: Jan. 31, 2012

(65) Prior Publication Data

US 2012/0193112 A1 Aug. 2, 2012

(30) Foreign Application Priority Data

Feb. 1, 2011 (DE) ..... 10 2011 010 069

(51) Int. Cl.

| | |
|---|---|
| ***E21B 4/04*** | (2006.01) |
| ***F02P 5/145*** | (2006.01) |
| ***F02D 31/00*** | (2006.01) |
| ***F02B 63/02*** | (2006.01) |

(52) U.S. Cl.

CPC ..... *F02D 31/009* (2013.01); *F02B 63/02* (2013.01)

(58) Field of Classification Search

CPC ..... F02D 5/00; F02D 45/00; F02P 5/02; F02P 5/145

USPC ..... 173/1, 2, 4; 123/335, 339.11, 350; 30/380, 381, 382, 383

See application file for complete search history.

(56) References Cited

U.S. PATENT DOCUMENTS

| | | | | |
|---|---|---|---|---|
| 4,491,105 | A * | 1/1985 | Johansson | 123/335 |
| 4,610,231 | A * | 9/1986 | Nakata et al. | 123/406.53 |
| 7,381,009 | B2 * | 6/2008 | Jenkins et al. | 404/84.1 |
| 2006/0065236 | A1 * | 3/2006 | Andersson et al. | 123/335 |
| 2006/0086337 | A1 * | 4/2006 | Nickel | 123/335 |
| 2007/0034190 | A1 * | 2/2007 | Schieber et al. | 123/406.57 |
| 2008/0041146 | A1 * | 2/2008 | Leufen | 73/116 |
| 2009/0193669 | A1 | 8/2009 | Gorenflo | |
| 2010/0012084 | A1 | 1/2010 | Andersson et al. | |

FOREIGN PATENT DOCUMENTS

WO WO 2009/085006 A1 7/2009

* cited by examiner

*Primary Examiner* — Nathaniel Chukwurah
(74) *Attorney, Agent, or Firm* — Walter Ottesen P.A.

(57) ABSTRACT

A method controls the rotational speed limiting of an engine in a handheld work apparatus. The crankshaft of the engine drives a worktool via a clutch which engages in dependence on the motor rotational speed. Above an engaging speed of the clutch, a drive connection with the crankshaft is made and below the engaging speed, the drive connection is interrupted. A speed control unit monitors the rotational speed of the engine and includes a rotational speed lock circuit which limits the speed to a limit below the engaging speed. During the start of the engine, the lock circuit is switched on; it is switched off after the engine has been taken into operation when a deactivation signal is present, wherein the deactivation signal is generated when an operation change signal of the work apparatus is detected.

22 Claims, 2 Drawing Sheets

METHOD FOR CONTROLLING THE LIMITING OF THE ROTATIONAL SPEED OF A COMBUSTION ENGINE

CROSS REFERENCE TO RELATED APPLICATION

This application claims priority of German patent application no. 10 2011 010 069.5, filed Feb. 1, 2011, the entire content of which is incorporated herein by reference.

FIELD OF THE INVENTION

The invention relates to a method for controlling the limiting of the rotational speed of a combustion engine in a handheld work apparatus.

BACKGROUND OF THE INVENTION

Portable, handheld work apparatuses such as chain saws, cut-off machines, hedge trimmers, blower apparatuses or the like are usually driven by a combustion engine which on location has to be taken into operation via a starting unit. Prior to the activation of the starting unit, which, for example, can be a pull starter, the combustion engine is placed into a starting mode, that is the fuel supply and the combustion air supply are set correspondingly. This can, for example, be done by adjusting a choke flap or a throttle flap in the intake channel.

When the combustion engine starts after multiple starting strokes, care must be taken that the rotational speed of the combustion engine does not increase above the engaging rotational speed of the clutch in the starting phase, via which clutch the worktool is driven. The clutch, typically a centrifugal clutch, engages above an engaging rotational speed and disengages the worktool from the drive below the engaging rotational speed. In order to ensure that the rotational speed of the combustion engine does not increase above the engaging rotational speed in the starting phase of the combustion engine, a rotational speed lock circuit is provided which holds the current rotational speed of the combustion engine below the engaging rotational speed electronically and preferably forces the current rotational speed below a limit rotational speed of the rotational speed lock circuit.

When the rotational speed lock circuit is switched on, the rotational speed control unit will constantly attempt to keep the rotational speed below the predetermined limit rotational speed of the rotational speed lock circuit via regulator interventions.

For this reason, after the starting phase has run its course, the rotational speed lock circuit has to be switched off so that the operator can use the entire rotational speed range of the combustion engine for the work assignment.

SUMMARY OF THE INVENTION

It is an object of the invention to provide a method which effects the switching off of a rotational speed lock circuit with little technical complexity.

The object is achieved according to the invention in that a deactivation signal for switching off the rotational speed lock circuit is not generated and used until an operating change signal of the work apparatus is detected, that is the operating state of the work apparatus is changed.

In a particular manner, the operating change signal of the work apparatus is detected in that the current rotational speed of the combustion engine has increased over the limit rotational speed of the rotational speed lock circuit. This is possible when the operator applies full throttle with the rotational speed lock circuit switched on, so that the rotational speed open loop control unit runs out of its regulating range; the rotational speed open loop control unit is therefore not able to hold the current rotational speed of the combustion engine below the limit rotational speed of the rotational speed lock circuit in the full throttle position of the throttle flap. The rotational speed open loop control unit hits its regulating limits so that the rotational speed of the combustion engine can increase above the limit rotational speed of the rotational speed lock circuit in the full throttle position despite the fact that the rotational speed lock circuit is switched on. This significant increase above the limit rotational speed is evaluated and an operation change signal is generated which leads to a deactivation signal and shutting off of the rotational speed lock circuit.

Thus, without relatively great technical complexity, the ability to deactivate the rotational speed lock circuit as soon as the operator fully opens the throttle is provided.

Expediently, the operation change signal is only generated after the current rotational speed of the combustion engine is more than 20%, in particular more than 50% above the limit rotational speed of the rotational speed lock circuit. If this condition is satisfied, it can be safely assumed that the rotational speed open loop control circuit is outside of its regulating range because the operator is applying full throttle, that is the operator wants to have the entire rotational speed range of the combustion engine available. The rotational speed lock circuit is switched off.

An operating change signal can also be derived from the upward slope of the course of the current rotational speed as a function of time. If the operator applies full throttle when the rotational speed lock circuit is switched on, the rotational speed increase, that is the rotational speed spike over a unit of time, is significantly steeper than during the starting mode of the combustion engine. This can be done in a simple manner by monitoring the upward slope, that is the mathematical first derivative of the course of the current rotational speed as a function of time, that is, $\Delta n/\Delta t$. If a significantly steep rotational speed increase is present, that is the mathematical value $\Delta n/\Delta t$ is greater than a predetermined limit value, an operation change signal is generated which leads to the deactivation signal for the rotational speed lock circuit.

In a simple way, the operation change signal can also be derived from the frequency of the regulating interventions of the rotational speed open loop control unit to maintain the limit rotational speed of the rotational speed lock circuit. When the rotational speed lock circuit is switched on when the current rotational speed approaches the limit rotational speed, the rotational speed open loop control circuit will exhibit regulating activity, that is executing a higher number of regulating interventions in the ignition than when the current rotational speed is significantly below the limit rotational speed. If the current rotational speed increases above the limit rotational speed, the regulating activity, that is the number of regulating interventions, will be extremely high. An operation change signal can thus be derived from the monitoring of the regulating activity in order to generate and use the deactivation signal for the rotational speed lock circuit. The number of regulating interventions over time is monitored in a simple manner; if the number of regulating interventions per unit of time exceeds a predetermined value, this is an indication that the operator has applied full throttle and is demanding the entire rotational speed range. If the predetermined value of regulating interventions per unit of time is thereby exceeded, the system outputs an operation change signal which leads to the switching off of the rotational speed lock circuit.

It can be advantageous to generate the operation change signal in dependence on the output signal of a pressure sensor in the crankcase or in the intake channel of the combustion engine. While idling, there are different pressure conditions in the intake channel than under full load, so that the pressure change is sufficient in order to conclude that the operating state of the combustion engine is different. If the operator applies full throttle, the pressure conditions will change significantly, for example, the negative pressure in the intake channel and/or in the crankcase will drop greatly, which indicates the change of the operating mode of the combustion engine.

In an embodiment of the invention, it can be practical to derive the operation change signal from a condition change of an operating element of the work apparatus. For this, sensors which output an operation change signal when an operating element is actuated are practical. Thus, the operation change signal can be generated by a sensor when the throttle lever of the combustion engine is actuated or by a position sensor on the throttle flap or on the choke flap. An operation change signal can also be derived from the resetting of an operating mode selector from the starting mode into the operating mode.

Advantageously, the deactivation signal is not generated until a predeterminable amount of time has transpired after the start of the combustion engine. Thus it is ensured that the combustion engine has reached a stable operating state before the entire rotational speed range is made available.

It can also be practical to generate the deactivation signal only when the operation change signal has been present for a predetermined amount of time.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
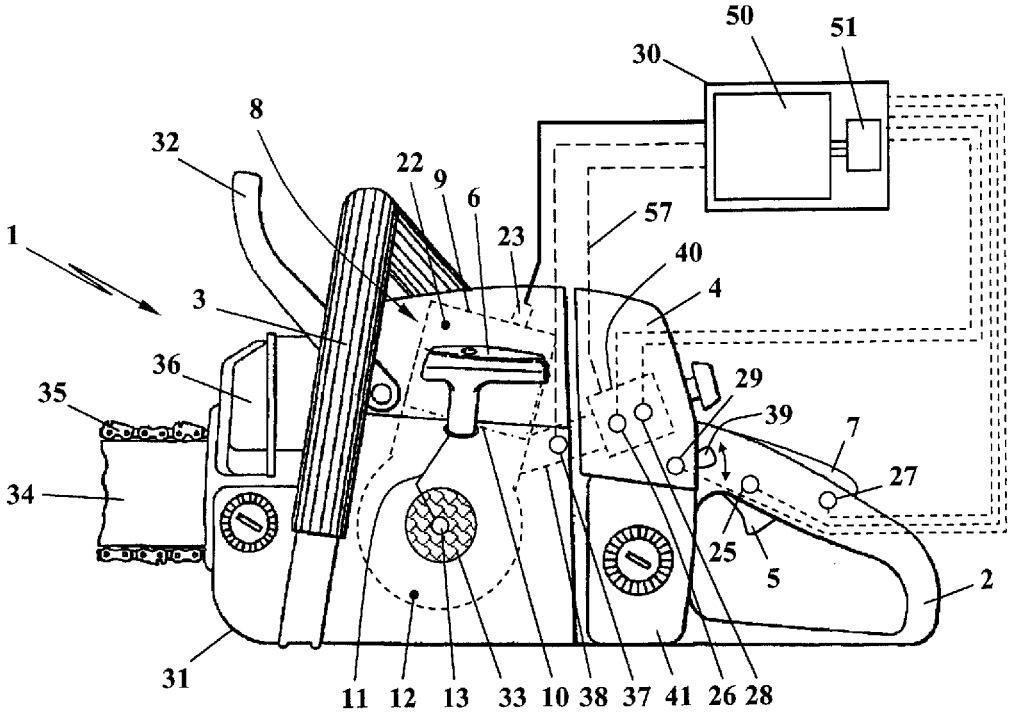
FIG. 1 shows a schematic side view of a chain saw having a combustion engine.

FIG. 1 schematically shows a chain saw as an example for a handheld work apparatus 1. This portable, handheld work apparatus 1 represents, by way of example, other portable, handheld work apparatuses 1 such as cut-off machines, hedge trimmers, brush cutters, pole pruners, blower apparatuses or the like.

The shown work apparatus 1 has a housing 31 which principally serves as the receptacle for a combustion engine 8. In the shown exemplary embodiment, the combustion engine 8 is a single cylinder two-stroke engine; a configuration as a single cylinder four-stroke engine can also be practical.

The work apparatus 1 has a back handle 2 arranged in the longitudinal direction of the housing 31 as well as a front, bale handle 3 which extends over the top side of the housing 31 transversely to the longitudinal direction of the housing 31. In the shown exemplary embodiment of a chain saw, a hand guard 32, which is configured as a trigger for a safety braking unit not shown, is assigned to the front handle 3.

In the longitudinal direction of the housing 31 on the side opposite the handle 2, a guide bar 34 is fixed. A saw chain 35 is guided in the peripheral groove of the guide bar 34. The saw chain 35 is driven via a drive sprocket, not shown, and a clutch 33 by a crankshaft 13 of the combustion engine 8. The crankshaft 13 is connected to a piston 10, which delimits a combustion chamber 22 in the cylinder 9 of the combustion engine 8, via a connecting rod 11. The air/fuel mixture required to operate the combustion engine is drawn into the crankcase 12 of the combustion engine 8 via an intake channel 38 and is ignited in the combustion chamber 22 via a spark plug 23. The air/fuel mixture is provided by a fuel system 40 which is received in an air filter box 4 of the housing 31 and is supplied from a fuel tank 41.

A throttle lever 5 for controlling the rotational speed of the combustion engine 8 is provided on the inner side of the back handle 2 of the work apparatus 1. A throttle lever lock 7 is arranged on the longitudinal side of the handle 2 which is opposite the throttle lever 5. The throttle lever 5 can only be actuated when the throttle lever lock 7 is pressed down.

Further, an operating mode selector 39, which can select operating modes such as "stop", "operating", "start" or the like, is provided on the housing 31 in the region of the throttle lever 5. The combustion engine is switched into a corresponding operating state via the operating mode selector 39.

In the shown exemplary embodiment according to FIG. 1, the combustion engine is started via a pull starter 6, which—in a known manner—engages at one end of the crankshaft 13 and rotates the same to start the combustion engine 8.

Figure 2:
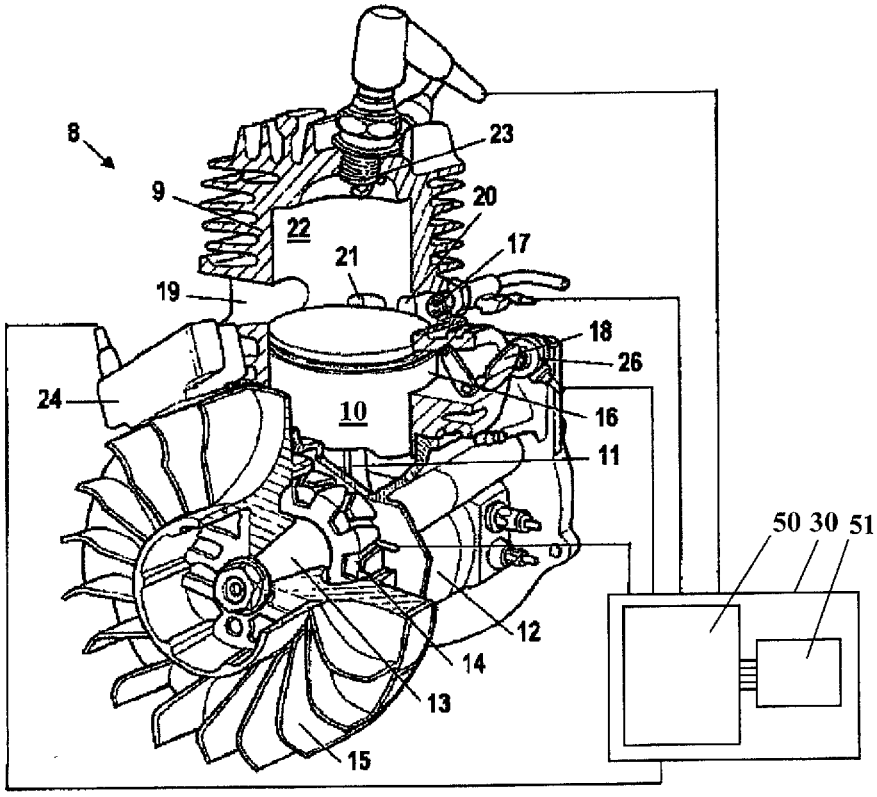
FIG. 2 shows a schematic diagram of a partially sectioned combustion engine for handheld work apparatuses according to FIG. 1; and, FIG. 3 shows a schematic view of a flow diagram for the operation of a rotational speed lock circuit.

In FIG. 2, a combustion engine is shown which, in its basic configuration, corresponds to the combustion engine 8 in the handheld work apparatus of FIG. 1. In the exemplary embodiment of FIG. 2, a fuel valve 17, which opens into a transfer channel 20 of the two-stroke engine, is provided to supply fuel in place of the fuel system 40 at the intake channel 38. In the shown position of the piston 10 near bottom dead center, the volume of the crankcase 12 is connected to the combustion chamber 22 via each of two symmetrically arranged transfer channels 20 and 21. The combustion air, which is drawn into the crankcase 12 via an inlet 16, is conveyed into the combustion chamber 22 via the transfer channels 20 and 21 and is conveyed into the combustion chamber 22 together with the fuel drawn into the transfer channel 20. The mixture is ignited by the spark plug 23 there, whereby the outlet 19 opens during the downward stroke of the piston 10 and the exhaust gases are discharged via a muffler 36 (FIG. 1).

The spark plug 23 is connected to an ignition unit 30 which triggers a spark at the spark plug 23 in dependence on the signals of an ignition module 24 and other variables. The ignition module 24 works in conjunction with a rotating fan wheel 15 which is fixed on one end of the crankshaft 13 and has corresponding circumferential magnets for the induction of the ignition energy in the ignition module 24.

It can be practical to arrange a generator 14, which can also provide the energy needed for the ignition by the spark plug 23, on the crankshaft 13 of the combustion engine 8. The AC generator 14 is connected to the ignition unit 30 and feeds the AC signals into the ignition unit 30. The generator 14 further makes a rotational speed signal available, whereby the current rotational speed (n) of the crankshaft 13 or of the combustion engine 8 is reported to the ignition unit 30.

The inlet 16 of the combustion engine 8, which connects to an intake channel, opens into the crankcase 12 and is controlled by the reciprocating piston 10. A position sensor 26 is arranged on the throttle flap 18. The position sensor 26, for example, outputs an operation change signal when the throttle flap is fully open and with this indicates a change of the operating state of the combustion engine 8.

In the same manner, a position sensor 28 can be arranged on the choke flap. The position sensor 28, for example, outputs an operation change signal when the choke is closed and with this indicates a change of the operating state, that is shows the operating mode "start". If the position sensor 28 is assigned to the open position of the choke flap, the operation change signal is outputted when the choke flap is in its out of service position; thus, the engine does not experience any starting enrichment, and thus is running in the normal operating mode. Correspondingly, a sensor 29 can be arranged on the operating mode selector 39. The sensor 29 outputs an operation change signal in each case when the operating mode selector 39 is switched over in its operating mode.

Operation change signals can also be generated when, for example, a sensor, for example a pressure sensor 37, is arranged in the intake channel 38. The negative pressure present in the intake channel directly enables a conclusion to be made as to the operating mode of the combustion engine so that when a significant pressure change takes place, for example, the pressure drops below a predetermined pressure value, an operation change signal is outputted.

Advantageously, the throttle lever 5 has a position sensor 25 and the throttle lever lock 7 has a position sensor 27. Both sensors 25 and 27 output a signal in each case when the corresponding lever is actuated, which signal is evaluated as an operation change signal.

The ignition unit 30 comprises a rotational speed control unit 50 which is assigned a rotational speed lock circuit 51. Impermissible rotational speed states of the combustion engine 8 are to be avoided via the rotational speed control unit 50. Thus, for example, the maximum rotational speed of the combustion engine 8 is set via the rotational speed control unit 50 in the same manner as an idling rotational speed. The rotational speed lock circuit 51 provides a limit rotational speed $n_G$ above which the rotational speed should not increase, especially during the starting of the combustion engine 8.

The predetermined limit rotational speed $n_G$ is below an engaging rotational speed of the clutch 33, which, in particular, is configured as a centrifugal clutch. The centrifugal clutch, in dependence on the engine rotational speed, defines a drive connection with the work tool of the work apparatus 1, wherein a torque transferring drive connection with the crankshaft 13 is established above an engaging rotational speed of the clutch 33. The drive connection is interrupted below the engaging rotational speed so that the work tool stands still.

Particularly when starting the combustion engine via a pull starter 6 it is necessary that the work tool does not start up in an uncontrolled manner. Here, the rotational speed lock circuit, the limit rotational speed $n_G$ of which is below the engaging rotational speed of the centrifugal clutch by a protective distance, acts. Thus, it is ensured that in the case of fixed starting settings, the combustion engine 8 does not run up above the limit rotational speed.

Figure 3:
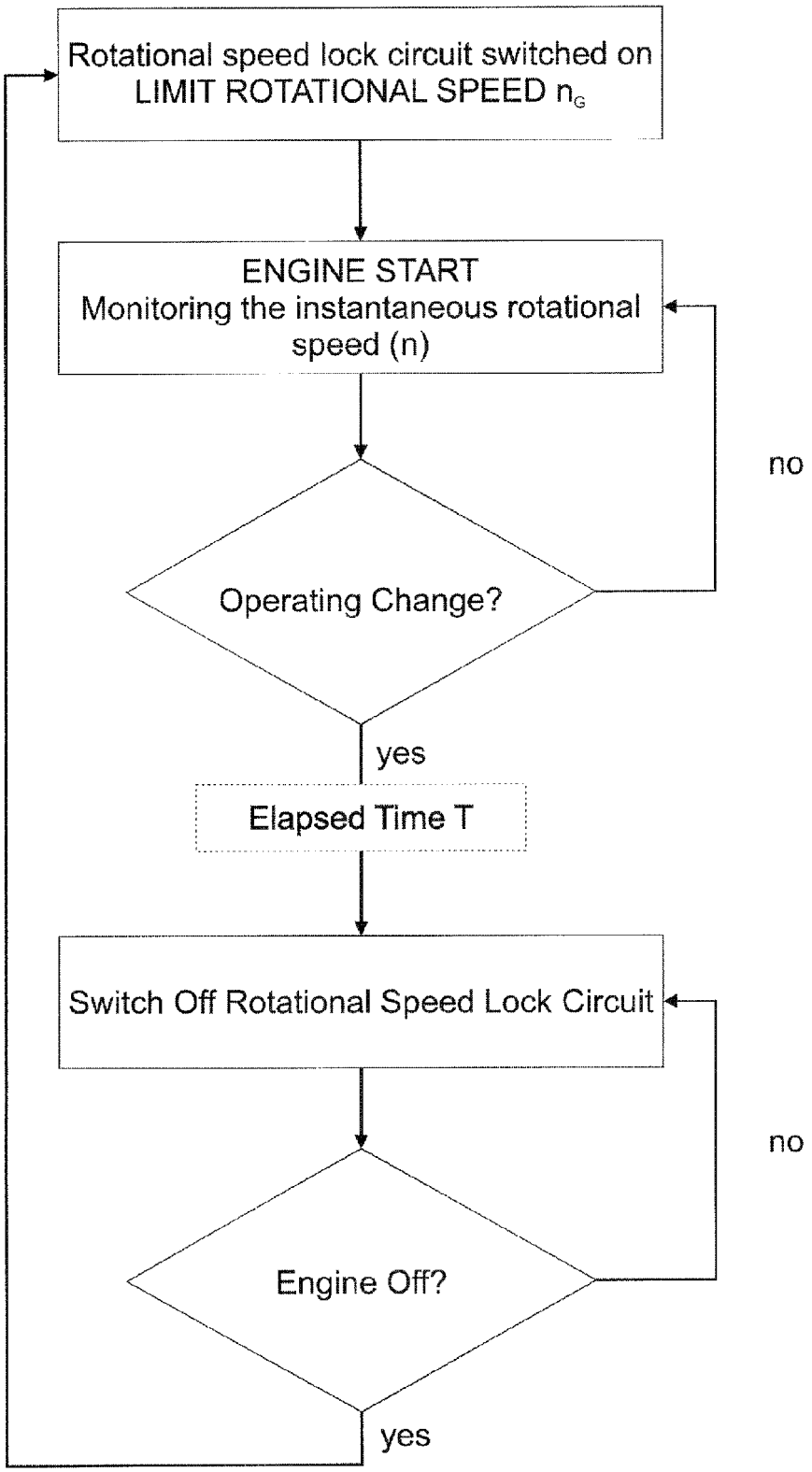

The rotational speed lock circuit 51 is switched off as a result of the generation of a deactivation signal only during the operation of the combustion engine, that is, after the completion of the start phase of the combustion engine. The deactivation signal is, for example, generated by the rotational speed control unit 50 when an operation change signal of the work apparatus is detected, thus a change of operating mode of the work apparatus is present. Such a continuous query, which can take place in the rotational speed control unit 50, is shown in FIG. 3.

The rotational speed lock circuit 51 is initially switched on. The rotational speed lock circuit 51 thus provides the rotational speed control unit 50 with a limit rotational speed $n_G$.

Now the combustion engine 8 is—via the pull starter 6—started, wherein the current rotational speed (n) of the combustion engine is continuously monitored. Thereby, the rotational speed control unit ensures that the current rotational speed (n) remains below the limit rotational speed $n_G$.

After the start of the combustion engine, it is continuously monitored whether an operating change can be detected.

As described above, the sensors (25, 26, 27, 28, 37) output operation change signals which enable a conclusion to be made as to whether a change in the operating state of the combustion engine has taken place. Thus, in the case where the throttle lever 5 is actuated and a corresponding signal of the position sensor 25 is present, the system assumes that the operator wants to accelerate the combustion engine in order to perform work. The signal of the sensor 25 is processed as an operation change signal in the rotational speed control unit 50 or in the rotational speed lock circuit 51 and, as a reaction, the rotational speed lock circuit 51 is switched off. The full rotational speed range of the combustion engine is available to the operator for his work.

After the rotational speed lock circuit 51 is switched off, it is continuously checked whether the combustion engine is still in operation. If the operator switches the machine off, the rotational speed lock circuit 51 is immediately switched to be active, so that the rotational speed lock circuit 51 again limits the permissible rotational speed to the limit rotational speed $n_G$ below the engaging rotational speed of the clutch 33 during the next start of the combustion engine.

In a corresponding manner, the position sensor 26 will output an operation change signal when the throttle flap is moved out of the idling position or is in the full throttle position. The sensor 28 on the choke flap outputs an operation change signal when the choke flap is moved into its open position. Correspondingly, the sensor 29 can output an operation change signal which leads to the switching off of the rotational speed lock circuit when an operating mode selector is returned from the starting mode to the operating mode.

Aside from position sensors, it can also be practical to use a pressure sensor 37 which captures the negative intake pressure in the intake channel 38 and, when a corresponding operating pressure is present, outputs an operation change signal which leads to a deactivation signal which is used to switch off the rotational speed lock circuit. During idling, different pressure conditions are present in the intake channel as well as in the crankcase than are present under full load, so that a significant pressure change is sufficient in order to conclude that there has been a change in the operating state of the combustion engine. If the operator applies full throttle, the pressure conditions change in such a manner, for example the negative pressure in the intake channel and/or in the crankcase drop sharply, which indicates the change in the operating mode of the combustion engine. This can be correspondingly evaluated and correspondingly an operation change signal can be generated.

The possibility of a sensorless capturing of the change of the operating state is to be particularly emphasized. The rotational speed control unit 50 has a system-induced regulating range within which a change of the rotational speed is possible within a specific range. Thus, for example, the ignition angle cannot be changed as desired just as the amount of fuel supplied via a valve cannot. This means that even a rotational speed control unit 50 has system-induced regulating limits above which a reasonable regulation is no longer possible.

This circumstance can be used to recognize the change of the operating state undertaken by the operator. If the rotational speed lock circuit 51 is switched on, namely, the rotational speed control unit 50 fulfills its task where the throttle flap and the choke flap are in the starting position and the current rotational speed (n) of the combustion engine 8 is held below the limit rotational speed $n_G$. If the operator applies full throttle when the rotational speed lock circuit 51 is switched on, there is such a high energy input into the combustion engine 8 that its current rotational speed (n) increases above the limit rotational speed $n_G$ despite the rotational speed lock circuit 51 being switched on and the intervention of the rotational speed control unit 50. In the full throttle position of the throttle lever 5 or of the throttle flap 18, the rotational speed control unit is no longer able to hold the current rotational speed (n) below the limit rotational speed.

Although the rotational speed control circuit will continue to intervene in order to lower the rotational speed, this will not be fully possible anymore because of the configuration of the entire system. The current rotational speed (n) of the combustion engine 8 exceeding the limit rotational speed $n_G$ of the rotational speed lock circuit 51 is detected and from this the operation change signal is derived, which—see FIG. 3—leads to a deactivation signal for the rotational speed lock circuit 51. Without a sensor, the system can thus recognize that the operator is using the machine in a work application and can switch off the rotational speed lock circuit 51. In a simple manner, the operation change signal is generated when the current rotational speed (n) of the combustion engine 8 is more than 20%, in particular more than 50% above the limit rotational speed of the rotational speed lock circuit 51.

An operation change signal can also be derived from the increase of the current rotational speed (n) as a function of time. If the operator suddenly fully opens the throttle, the rotational speed increase of the current rotational speed (n), that is, the rotational speed spike over a time unit, becomes substantially steeper than when the machine is idling. The slope, that is the mathematical first derivative of the course of the current rotational speed as a function of time, that is $\Delta n/\Delta t$, is monitored in a simple manner. If a significantly steep rotational speed increase is present, that is the mathematical value $\Delta n/\Delta t$ is greater than a predetermined limit value, an operation change signal is generated which leads to the deactivation signal for the rotational speed lock circuit 51.

A further technically simple possibility to derive an operation change signal is to monitor the regulator activity of the rotational speed control unit itself. The operating state of the combustion engine can be derived from the frequency of the regulating interventions of the rotational speed control unit to keep within the limit rotational speed of the rotational speed lock circuit. With the rotational speed lock circuit switched on and when the current rotational speed of the combustion engine approaches the limit rotational speed, the rotational speed control circuit will exhibit regulating activity, that is, will execute a higher number of regulating interventions in the ignition than when the current rotational speed is substantially below the limit rotational speed. If the current rotational speed exceeds the limit rotational speed, the regulating activity, that is, the number of regulating interventions, will be extremely high. Thus, an operation change signal can be derived from the monitoring of the regulating activity in order to generate and use the deactivation signal for the rotational speed lock circuit.

In a simple manner, the number of regulating interventions over time is monitored; if the number of regulating interventions per time unit exceeds a predetermined value, this is an indicator that the operator has applied full throttle and is demanding the entire rotational speed range. If the predetermined value of regulating interventions per time unit is thereby exceeded, the system outputs an operation change signal which leads to the rotational speed lock circuit 51 being switched off.

It can be advantageous that, where the operation change signal is present, the deactivation signal is only generated when a predetermined amount of time has transpired after the start of the combustion engine. In the same way, it can be practical to generate the deactivation signal only when the operating change signal has been present for a predetermined amount of time. In a development of the invention, the operation change signal can simultaneously be the deactivation signal.

It is understood that the foregoing description is that of the preferred embodiments of the invention and that various changes and modifications may be made thereto without departing from the spirit and scope of the invention as defined in the appended claims.

What is claimed is:

1. A method for controlling the rotational speed limiting of a combustion engine in a handheld work apparatus, the combustion engine including: a cylinder having a combustion chamber delimited by a piston; the piston being configured to drive a crankshaft via a connecting rod; the crankshaft being configured to drive a worktool via a clutch which engages in dependence on a rotational speed (n) of the combustion engine whereby a drive connection with the crankshaft is made above an engaging rotational speed of the clutch and is interrupted below the engaging speed; a spark plug arranged in the combustion chamber; and, an ignition arrangement configured to drive said spark plug, the ignition arrangement including a rotational speed control unit for the rotational speed (n) of the combustion engine and a rotational speed lock circuit which limits the rotational speed (n) of the combustion engine to a limit rotational speed ($n_G$) below the rotational speed at which the clutch engages which clutch closes in dependence upon the rotational speed (n) of the combustion engine; said method comprising the steps of:

switching on the rotational speed lock circuit when starting the combustion engine;

detecting when an operating change signal of said combustion engine is present;

generating a deactivation signal when the operating change signal of said combustion engine has been detected;

switching off the rotational speed lock circuit only during operation of the combustion engine after the deactivation signal is generated;

deriving the operating change signal from the slope of the course of the current rotational speed (n) of said combustion engine as a function of time; and, generating the operating change signal then when there is an increase in rotational speed per unit of time ($\Delta n/\Delta t$) which exceeds a pregiven threshold value.

2. A method for controlling the rotational speed limiting of a combustion engine in a handheld work apparatus, the combustion engine including: a cylinder having a combustion chamber delimited by a piston; the piston being configured to drive a crankshaft via a connecting rod; the crankshaft being configured to drive a worktool via a clutch which engages in dependence on a rotational speed (n) of the combustion engine whereby a drive connection with the crankshaft is made above an engaging rotational speed of the clutch and is interrupted below the engaging speed; a spark plug arranged in the combustion chamber; and, an ignition arrangement configured to drive said spark plug, the ignition arrangement including a rotational speed control unit for the rotational speed (n) of the combustion engine; a rotational speed lock circuit which limits the rotational speed (n) of the combustion engine to a limit rotational speed ($n_G$) below the rotational speed at which the clutch engages; said method comprising the steps of:

causing the rotational speed lock circuit to be in an active state when starting the combustion engine;

detecting when an operating change signal of said combustion engine is present;

generating a deactivation signal to switch off the rotational speed lock circuit when the operating change signal of said combustion engine has been detected; and, switching off the rotational speed lock circuit only during operation of the combustion engine after the deactivation signal is generated.

3. The method of claim 2 further comprising the step of deriving the operating change signal from the current rotational speed (n) of the combustion engine when said current rotational speed (n) exceeds the limit rotational speed ($n_G$) of the rotational speed lock circuit.

4. The method of claim 3, wherein the operating change signal is generated when the current rotational speed (n) of the combustion engine is greater than 20% above the limit rotational speed ($n_G$) of the rotational speed lock circuit.

5. The method of claim 3, wherein the operating change signal is generated when the current rotational speed (n) of the combustion engine is greater than 50% above the limit rotational speed ($n_G$) of the rotational speed lock circuit.

6. The method of claim 2 further comprising the step of deriving the operating change signal from the frequency of regulating interventions of the rotational speed control unit to maintain the limit rotational speed ($n_G$) of the rotational speed lock circuit.

7. The method of claim 2 further comprising the step of generating the operating change signal by a pressure sensor arranged in at least one of a crankcase of the combustion engine and an intake channel of the combustion engine.

8. The method of claim 2 further comprising the step of deriving the operating change signal from a state change of an operating element of the work apparatus.

9. The method of claim 8, wherein the operating change signal is generated when a throttle lever of the combustion engine is actuated.

10. The method of claim 8, wherein the operating change signal is generated by a position sensor on a throttle flap of the combustion engine.

11. The method of claim 8, wherein the operating change signal is generated by a position sensor on a choke flap of the combustion engine.

12. The method of claim 2, wherein the deactivation signal is generated only when a predetermined amount of time has elapsed after the start of the combustion engine.

13. The method of claim 2, wherein the deactivation signal is generated only when the operating change signal is present for a predetermined amount of time.

14. The method of claim 2, wherein the work apparatus is a chain saw.

15. The method of claim 2, wherein the work apparatus is a cut-off machine.

16. The method of claim 15, wherein the operating change signal is generated by a position sensor on the choke flap.

17. The method of claim 2, wherein the work apparatus is a hedge trimmer.

18. The method of claim 2, wherein the work apparatus is a brushcutter.

19. The method of claim 2, wherein the work apparatus is a blower apparatus.

20. A method for controlling the rotational speed limiting of a combustion engine in a handheld work apparatus, the combustion engine including: a cylinder having a combustion chamber delimited by a piston; the piston being configured to drive a crankshaft via a connecting rod; the crankshaft being configured to drive a worktool via a clutch which engages in dependence on a rotational speed (n) whereby a drive connection with the crankshaft is made above an engaging rotational speed of the clutch and is interrupted below the engaging speed; a spark plug arranged in the combustion chamber;

and, an ignition arrangement configured to drive said spark plug, the ignition arrangement including a rotational speed control unit for the rotational speed (n) of the combustion engine; a rotational speed lock circuit which limits the rotational speed (n) of the combustion engine to a limit rotational speed ($n_G$) below the rotational speed at which the clutch engages; said method comprising the steps of:

switching on the rotational speed lock circuit when starting the combustion engine;

detecting when an operating change signal of said combustion engine is present;

generating a deactivation signal when the operating change signal of said combustion engine has been detected;

switching off the rotational speed lock circuit only during operation of the combustion engine after the deactivation signal is generated;

deriving the operating change signal from a state change of an operating element of the work apparatus; and, generating the operating change signal when an operating mode selector is reset from the start mode into the operating mode.

21. The method of claim 20, wherein said operating change signal is generated when actuating a throttle lever of said combustion engine.

22. The method of claim 20, wherein the operating change signal is generated by a position sensor on the throttle flap.

* * * * *